United States Patent [19]

Eakin

[11] 4,354,510

[45] Oct. 19, 1982

[54] CIGARETTE SNUFFER

[76] Inventor: Lourie L. Eakin, 223 Wesley Ave., Ventura, Calif. 93003

[21] Appl. No.: 259,841

[22] Filed: May 4, 1981

[51] Int. Cl.[3] ..... A24F 13/18

[52] U.S. Cl. ..... 131/235 R; 131/256; 131/241

[58] Field of Search ..... 131/235, 256, 240, 241

[56] References Cited

U.S. PATENT DOCUMENTS

| | | | |
|---|---|---|---|
| 1,637,978 | 8/1927 | Anderson | 131/235 R |
| 2,790,447 | 4/1957 | Simpson | 131/235 R |
| 3,386,452 | 6/1968 | Davis | 131/235 R X |
| 4,240,449 | 12/1980 | Caravello | 131/256 X |

*Primary Examiner*—Stephen C. Pellegrino
*Attorney, Agent, or Firm*—Jack C. Munro

[57] ABSTRACT

A cigarette snuffing device which comprises a small cylinder which is attached to a guide funnel to facilitate inserting of the lip portion of the cigarette into the small cylinder. Within the small cylinder is located an annular ridge at approximately the midpoint of the length of the small cylinder. The small cylinder has an open bottom. This cylinder and guide funnel are to be connectable with a bracket. The bracket is deformable to facilitate attachment to any particular desired structure.

3 Claims, 8 Drawing Figures

Fig. 1,
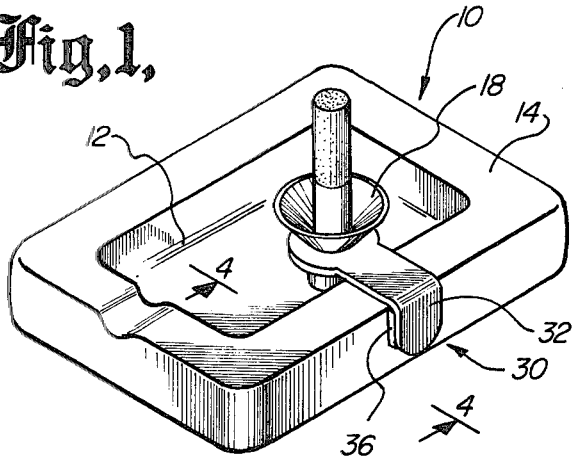
Fig. 5,
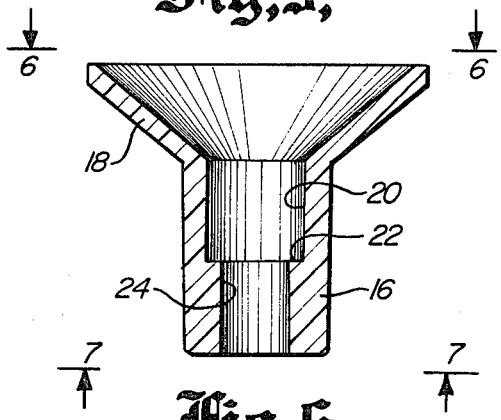
Fig. 2,
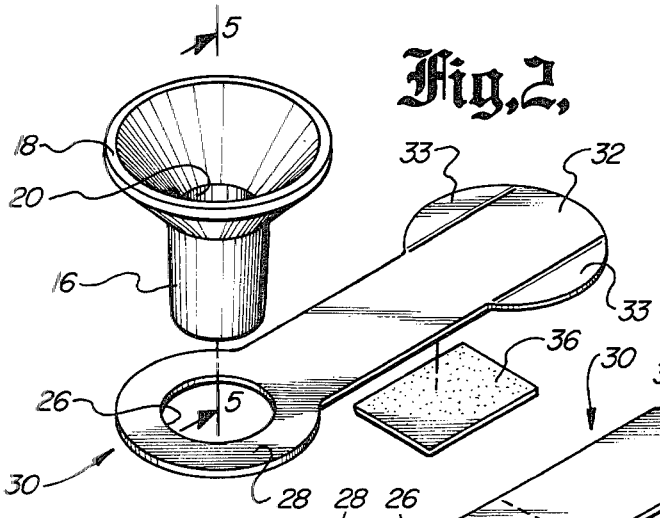
Fig. 6,
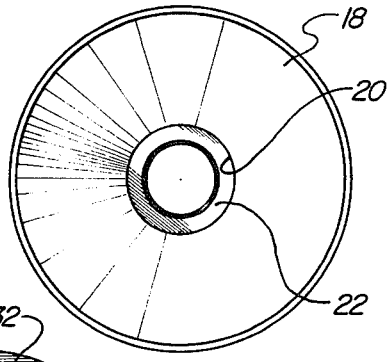
Fig. 3,
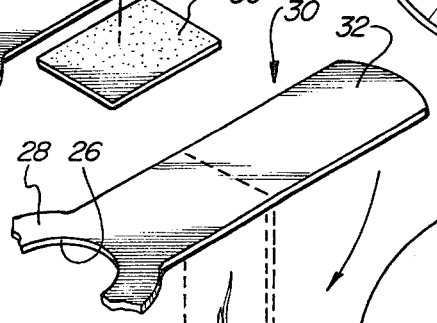
Fig. 7,
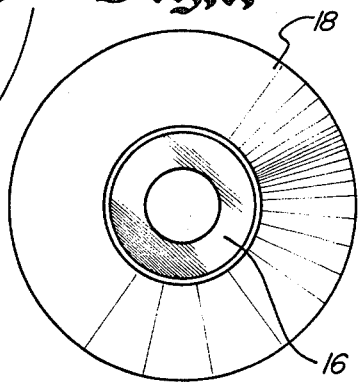
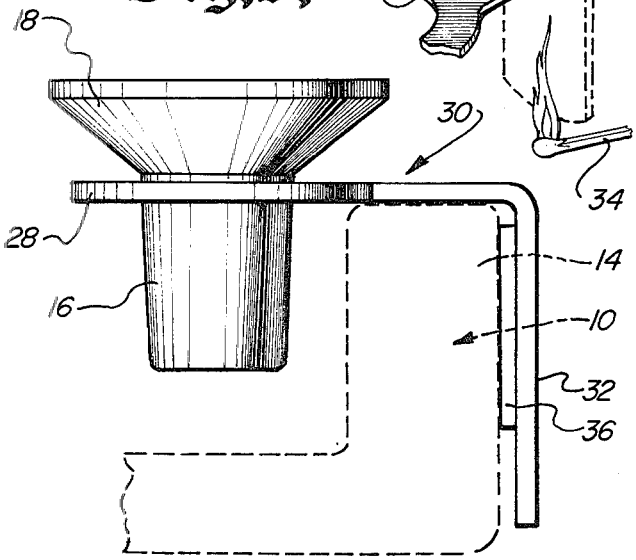
Fig. 4,
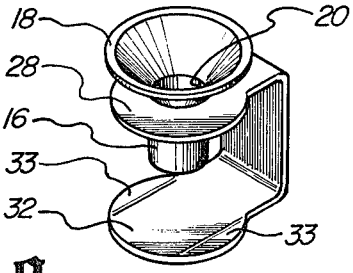
Fig. 8,

CIGARETTE SNUFFER

BACKGROUND OF THE INVENTION

The field of this invention relates to a cigarette snuffing attachment for ashtrays and other structures wherein the attachment can be modified in shape to connect with almost any outside structure.

In the home, and also in public places, such as passengers in automobiles and aircraft, hotel lobbys and auditoriums, there is a substantial danger of fire from incompletely distinguished cigarettes in conventional ashtrays. The crushing of cigarettes, which is the usual method of extinction in conventional ashtrays, often leaves smouldering remnants which constitutes a fire hazard. A much more effective method of extinction is to introduce the lighted end of a cigarette into a hollow cylinder of non-combustible material and of a diameter only slightly larger than the cigarette. In such a cylinder, a cigarette is totally extinguished in a very short period of time, usually within five seconds, due to lack of oxygen for burning.

In the past, there has been employed cylindrical shaped snuffers. Such cigarette snuffers are to be attached by a specific type of fastening device to an ashtray or similar structure, or is connected to a pedestal or stanchion of some type which is to be located within an ashtray or adjacent thereto. The prior art cigarette snuffer is designed to be incorporated within a single type of supporting apparatus which inherently limits its extent of use. There is a wide variety of structures to which it would be desirable to connect a cigarette snuffer. However, since all previous cigarette snuffers are designed with one particular attachment means in mind, there has not been a cigarette snuffer which has been adapted to be connectable to a wide variety of configurations of ashtrays or other types of supporting structure. A cigarette snuffer must be employed in combination with a structure such as a receptacle for the disposing of cigarettes. By itself, a cigarette snuffer is of little value. Previous to this invention, there has been no known cigarette snuffing device which is designed to be readily connectable to practically any configuration of cigarette disposal receptacle.

SUMMARY OF THE INVENTION

The cigarette snuffer of this invention takes the form of a guide funnel which connects with a tubular section. The tubular section has an interior chamber which is divided by an annular ridge into an upper enlarged portion and a lower smaller diametered section. The smaller diametered section is open to the ambient. A cigarette when inserted within the upper enlarged diametered section comes to rest against the annular ridge thereby forming a seal. The material of construction of the snuffer quickly dissipates heat from the cigarette, and also available oxygen is quickly utilized and the further lack of oxygen quickly extinguishes the cigarette. The exterior surface of the tubular section is tapered to facilitate a tight connection within a hole formed in a bracket member. The bracket member has an elongated extension. The extension is capable of being deformed and remain in any particular desired configuration by application of a small amount of heat to the bending area. This means that the bracket member can be readily deformed to facilitate attachment to a particular configuration of cigarette disposal receptacle.

The primary objective of this invention is to construct a cigarette snuffer which is readily connectable to practically any cigarette disposal receptacle by even the most unskilled individual.

Another objective of this invention is to construct a cigarette snuffer which is quite inexpensive and therefore available to the widest range of individuals.

BRIEF DESCRIPTION OF THE DRAWING

FIG. 1 is an isometric view of the cigarette snuffer of this invention showing the cigarette snuffer being installed upon an ashtray;

FIG. 2 is an exploded isometric view of the cigarette snuffer of this invention;

FIG. 3 is an isometric view of a portion of the attaching bracket member employed within the cigarette snuffer of this invention showing heat being applied to the bracket member to facilitate deforming of the bracket member for the purpose of attaching the cigarette snuffer of this invention to a particular location on the ashtray;

FIG. 4 is a side elevational view of the cigarette snuffer of this invention taken along line 4—4 of FIG. 1;

FIG. 5 is a cross-sectional view through the cigarette snuffing device of this invention taken along line 5—5 of FIG. 2;

FIG. 6 is a top plan view of the cigarette snuffing device of this invention taken along line 6—6 of FIG. 5;

FIG. 7 is a bottom view of the cigarette snuffing device of this invention taken along line 7—7 of FIG. 5; and FIG. 8 is a perspective view of the self-standing version of the cigarette snuffing device of this invention.

DETAILED DESCRIPTION OF THE SHOWN EMBODIMENT

Referring particularly to the drawing, there is shown a conventional ashtray 10 which has a cigarette disposal receptacle 12 enclosed by a sidewall 14. The cigarette snuffing device of this invention takes the form of the tubular section 16 and guide funnel section 18 is to be locatable within the receptacle 12. This location is to be accomplished by the user, as will become apparent further on in the specification.

The guide funnel 18 and tubular section 16 are to be constructed of a basically non-combustible plastic material. A desirable material would be polyphenylene sulfide plastic. However, it is considered to be within the scope of this invention that any desirable material could be employed.

The guide funnel 18 has an interior opening which connects with enlarged upper section 20 of the tubular section 16. Enlarged section 20 terminates in an annular ridge 22. Extending from the annular ridge is a smaller diametered section 24. It is to be noted that the length of the section 24 is approximately equal to the length of the section 20, but it is considered to be within the scope of this invention that this could be readily varied. Section 24 is open to the ambient.

The internal chamber of the guide funnel 18 is to facilitate insertion of the cigarette into the enlarged section 20. The enlarged section 20 is just slightly larger than the diameter of the cigarette so that the outer periphery of the cigarette comes to rest against the annular ridge 22. The contact of the cigarette with the ridge 22 forms a seal which prevents oxygen from flowing through the guide funnel and into the enlarged section 20 to permit the cigarette to continue to burn.

The burning cigarette quickly dissipates any oxygen contained within section 24, and oxygen being no longer available, the cigarette quickly extinguishes itself. Actually, this extinguishing procedure is just a matter of a few seconds. Any ash that is created is free to fall through the section 24 and into the ashtray receptacle 12. The material of construction of the tubular section 16 quickly draws the heat from the cigarette.

The exterior surface of the tubular section 16 is tapered. That is, the portion of the tubular section directly adjacent the guide funnel 18 is larger in diameter than the free outer end of the section 16. This tapering of the exterior of the tubular section 16 is so as to facilitate connection within hole 26 of ring shaped member 28 of the attachment member 30. The attachment member 30 is to be constructed of a fire retardant plastic, such as ABS. However, this material of construction is capable of deformation upon application of a certain amount of heat.

The tubular section 16 is to be inserted in the hole 26 in a tight fitting manner. The operator may remove the tubular section 16 if desired from the attaching member 30 so as to facilitate cleaning.

Extending from the ring 28 of the attaching member 30 is an extension 32. Basically, the extension 32 is no more than a flat plate. The outer end of the extension 32 is enlarged forming break away flanges 33. Let it be assumed that it is desirable to bend the extension 32 to a right angled configuration, as is shown in the drawings. The individual only needs to apply heat, such as from a match 34 across the extension 32 at the desired location of the bend. This application of heat only needs to be momentary. The operator then quickly extinguishes the match 34 and then bends the outer portion of the extension 32 to the dotted line position shown in FIG. 3. In just a few seconds, the extension 30 will cool sufficiently to be again rigid. The operator then applies a section 36 of double backed adhesive tape to this now deformed outer portion of the extension 32 and then the adhesive tape 36 is applied against the side wall 14 of the ashtray 10. When applying the extension 32 to the side of the ashtray 10, the flanges 33 are to be removed and discarded. When using the extension 32 as a stand (FIG. 8), the flanges are to remain to provide a wider supporting base. It is to be understood that it is within the scope of this invention that the extension 32 could be deformed to any desirable configuration depending upon the installation structure.

What is claimed is:

1. A cigarette snuffing apparatus comprising:

a tubular section having an internal chamber, said internal chamber being divided into an enlarged section and a smaller diametered section, an annular ridge separating said smaller diametered section from said enlarged section, said smaller diametered section being open to the ambient, said enlarged section connecting with the internal chamber of a guide funnel, said guide funnel being integrally secured to said tubular section, said tubular section having an exterior continuous side wall;

a sheet material bracket member, said continuous exterior surface of said tubular section being connectable to said bracket member, said bracket member being manually deformable into a configuration other than its initial configuration to facilitate attachment to a particular configuration of exterior structure, said bracket member being normally rigid, said bracket member being deformable by the application of heat to the area of the bracket member where the bending is to occur; and adhesive attachment means to connect with said said bracket member, said adhesive attachment means to connect with the separate structure to which the cigarette snuffer of this invention is to be connected.

2. The cigarette snuffing device as claimed in claim 1 wherein:

said continuous exterior surface of said tubular section being tapered, said bracket member including a hole, said tapered exterior surface of said tubular section to connect within said hole of said bracket member in a tight fitting manner, said hole being formed within a ring section of said bracket member.

3. A cigarette snuffing apparatus comprising:

a tubular section having an internal chamber, said internal chamber being divided into an enlarged section and a smaller diametered section, an annular ridge separating said smaller diametered section from said enlarged section, said smaller diametered section being open to the ambient, said enlarged section connecting with the internal chamber of a guide funnel, said guide funnel being integrally secured to said tubular section, said tubular section having an exterior continuous side wall;

a bracket member, said continuous exterior surface of said tubular section being connectable to said bracket member, a portion of said bracket member being capable of being readily formed into a configuration other than its initial configuration to facilitate attachment to a particular configuration of exterior structure;

said continuous exterior surface of said tubular section being tapered, said bracket member including a hole, said tapered exterior surface of said tubular section to connect within said hole of said bracket member in a tight fitting manner, said hole being formed within a ring section of said bracket member;

an elongated extension section being attached to said ring section, said elongated extension section being capable of being deformed by the application of heat;

adhesive attachment means to connect with said elongated section of said bracket member, said adhesive attachment means to connect with the separate structure to which the cigarette snuffer of this invention is to be connected; and said elongated extension section having an outer free end, said free end being enlarged by a pair of break away flanges.

* * * * *